United States Patent [19]

Kohler

[11] 4,428,500

[45] Jan. 31, 1984

[54] AUTOMATICALLY ERECTABLE LIQUID-TIGHT TRAY

[75] Inventor: Karl A. Kohler, Roselle, Ill.

[73] Assignee: Container Corporation of America, Chicago, Ill.

[21] Appl. No.: 355,772

[22] Filed: Mar. 8, 1982

[51] Int. Cl.[3] ..... B65D 3/00; B65D 5/56; B65D 77/06

[52] U.S. Cl. ..... 220/462; 206/217; 220/410; 229/1.5 B; 229/41 B

[58] Field of Search ..... 206/216, 217, 218, 524.2, 206/524.3, 524.4, 524.5; 220/408, 410, 462, 463; 229/1.5 B, 1.5 C, 3.1, 41 B, 41 D, 41 R

[56] References Cited

U.S. PATENT DOCUMENTS

| | | | |
|---|---|---|---|
| 1,002,346 | 9/1911 | Weeks | 229/1.5 B |
| 2,019,787 | 11/1935 | Leopold | 229/41 R |
| 2,337,199 | 12/1943 | Holy | 229/41 B |
| 2,493,337 | 1/1950 | Buttery | 220/463 |
| 2,834,533 | 5/1958 | Carew | 229/1.5 B |
| 3,206,094 | 9/1965 | Humphrey et al. | 220/462 |
| 3,373,917 | 3/1968 | Cox | 206/218 |
| 3,521,807 | 7/1970 | Weisberg | 220/462 |
| 3,542,566 | 11/1970 | Wakefield | 206/216 |
| 3,630,430 | 12/1971 | Struble | 229/1.5 B |
| 3,845,897 | 11/1974 | Buttery et al. | 229/41 B |
| 3,877,632 | 4/1975 | Steel | 229/1.5 B |
| 3,908,523 | 9/1975 | Shikaya | 229/1.5 B |
| 4,166,567 | 9/1979 | Beach, Jr. et al. | 229/23 BT |
| 4,267,955 | 5/1981 | Stuble | 229/41 B |
| 4,284,205 | 8/1981 | Hirata . | |

*Primary Examiner*—George E. Lowrance
*Assistant Examiner*—Jimmy G. Foster
*Attorney, Agent, or Firm*—Richard W. Carpenter; Davis Chin

[57] ABSTRACT

A liquid-tight, automatically erectable, self-supported, composite paperboard and plastic tray structure.

3 Claims, 5 Drawing Figures

AUTOMATICALLY ERECTABLE LIQUID-TIGHT TRAY

BACKGROUND OF THE INVENTION

1. Field of the Invention

This invention relates to liquid-tight trays, and especially to an automatically erectable structure.

2. Description of the Prior Art

A prior art search directed to the subject matter of this application in the United States Patent and Trademark Office disclosed the following U.S. Pat. Nos.: 2,114,624; 2,516,820; 2,779,462; 3,630,430; 3,888,163; 3,957,195; 4,185,764; 4,196,034; 4,267,955.

None of the prior art patents uncovered in the search disclosed a combination paper and plastic liquid-tight tray or cup structure which is automatically erectable and completely self-supporting like the structure of the present invention.

SUMMARY OF THE INVENTION

This invention relates to combination paper and plastic structures used for trays or cups and which are adapted to be automatically erectable.

It is a purpose of the invention to provide an automatically erectable tray or cup structure which may be used as a rinse cup in hospitals, for a drinking cup, or for any other type of purpose requiring a self-supported liquid-tight structure that can be automatically erected by grasping the structure with one hand and squeezing it.

This and other objects of the invention will be apparent from an examination of the following description and drawings.

It will be understood that, for purposes of clarity, certain elements may have been intentionally omitted from certain views where they are believed to be illustrated to better advantage in other views.

BRIEF DESCRIPTION OF THE DRAWINGS

Figure 5:
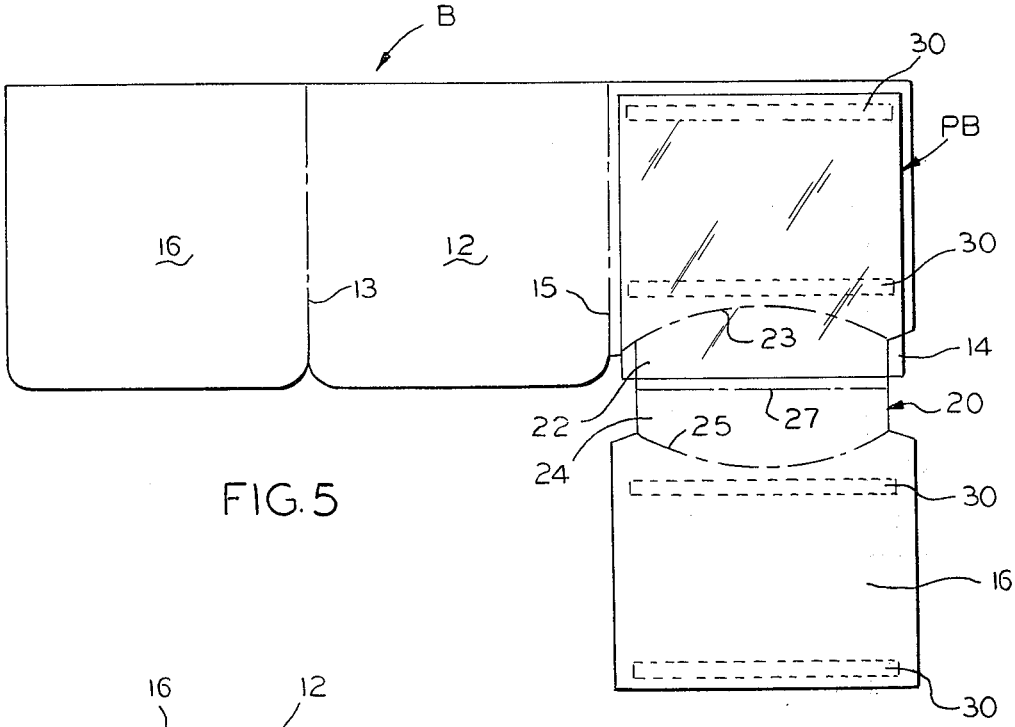
FIG. 5 is a plan view of the blank of foldable sheet material from which the tray illustrated in the other views may be formed, as seen with the plastic bag placed in position over one of the panels of the paperboard shell.
Figure 4:
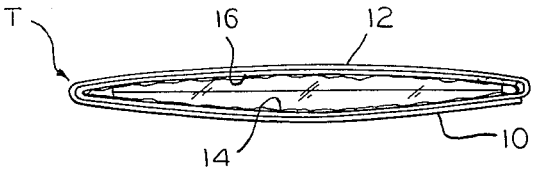
FIG. 4 is a top plan view of the structure illustrated in FIG. 3.
Figure 3:
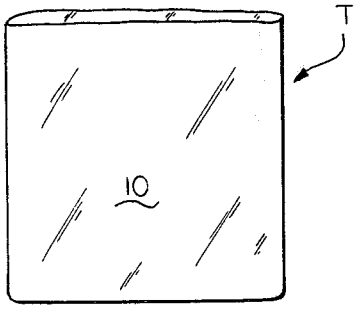
FIG. 3 is a side elevational view of the tray illustrated in FIGS. 1 and 2, but shown in a collapsed position prior to being erected.
Figure 2:
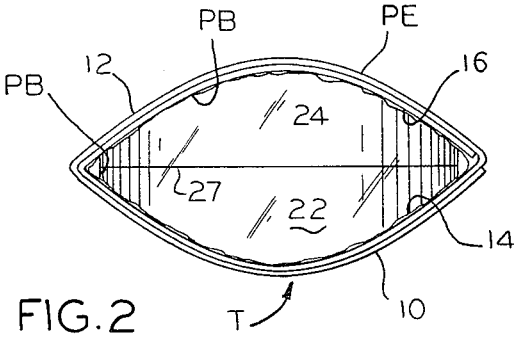
FIG. 2 is top a plan view of the structure illustrated in FIG. 1.
Figure 1:
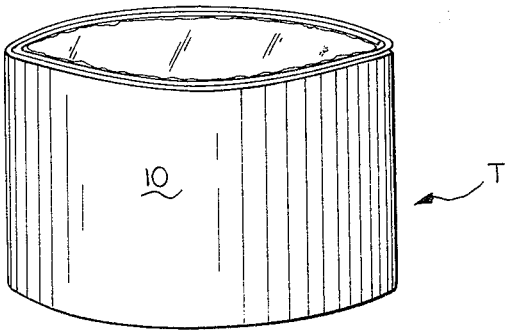
FIG. 1 is a perspective view of a tray embodying features of the invention, as seen in the erected position.

Referring now to the drawings for a better understanding of the invention, and particularly to FIGS. 2 and 5, it will be seen that the novel structure which can be used as a tray or cup, indicated generally at T, includes an outer paperboard envelope or shell, indicated generally at PE, and an inner liquid-tight plastic bag, indicated generally at PB. Shell PE may be formed from a unitary blank B of paperboard illustrated in FIG. 5.

Still referring to FIG. 5, it will be seen that the paperboard envelope or shell PE includes: a first outer side wall panel 10; a second outer side wall panel 12, foldably joined on fold line 13 to an adjacent edge of first outer side wall panel 10; a first inner side wall panel 14, foldably joined along fold line 15 to an adjacent edge of second outer side wall panel 12; and a second inner side wall panel 16, foldably joined to first inner side wall panel 14 by means of a bellows or gusset member 20.

Gusset member 20 includes a pair of generally semicircular first and second gusset sections 22 and 24 which are foldably joined along inwardly bowed fold lines 23 and 25 to adjacent edges of first and second inner side wall panels 14 and 16, respectively, and which are foldably joined to each other along a straight fold line 27.

In order to make the tray liquid-tight there may be provided a plastic bag PB which in the flat or collapsed condition is placed between inner and outer side wall panels 14 and 16 and adhesively secured thereto by strips of adhesive indicated generally at 30. In order to form the device after the bag PB has been placed in position and adhesively secured between the inner side wall panels, the first and second outer side wall panels are folded along fold lines 13 and 15 until they surround each of the respective inner side wall panels. They may be secured thereto in any desired manner such as by adhesive or other means.

Thus, it will be appreciated that, because of the novel construction of the gusset member 20 and the bowed fold lines 23 and 25 which curve away from each other and are spaced upwardly from the lower extremity of the first and second outer side wall panels 10 and 12, it is possible to erect the structure with one hand by merely grasping and squeezing the ends of the outer side wall panels 10 and 12. As this occurs fold lines 13 and 15, which represent the side edges of the tray are brought together and this causes the bellows member to pop into position. Because the bellows member is positioned above the lower extremity of the tray, the tray will be entirely self-supporting and can stand on the lower edges of the outer side wall panels.

What is claimed is:

1. In a collapsible, automatically erectable, liquid-tight tray, the combination of:

(a) an outer shell formed from a unitary blank of foldable paperboard and including a pair of opposed side wall panels foldably joined to each other at corresponding side edges to form, when in the erected position, a tubular structure open at the top;

(b) an inner shell disposed within said outer shell and including a pair of side wall panels, one of which is foldably joined at one side edge to an adjacent of one of said outer shell side wall panels;

(c) said inner shell side wall panels having lower portions interconnected by a bellows member which includes a pair of gusset elements foldably joined to each other and to respective side walls to form a collapsible bottom wall;

(d) a liquid-tight bag interposed between and secured to respective inner shell side wall panels to form a liner for said inner shell;

(e) means securing said inner and outer shell side wall panels in a fixed relationship;

(f) said bellows member being disposed above the lower edges of at least certain of said side wall panels to permit the tray to rest on said lower edges when said tray is in the erected position.

2. A tray according to claim 1, wherein the side wall panels of said inner and outer shells are of substantially the same width, but said outer shell side wall panels have a greater overall height than the height of said inner shell side wall panels.

3. A tray according to claim 1, wherein said bellows member gusset elements are joined to each other on a straight fold line and to respective inner shell side wall panels on oppositely bowed, curved fold lines, so that said tray will automatically move to open position when the opposite ends of said tray side walls are moved toward each other.

* * * * *